United States Patent [19]

Chiba

[11] 4,146,132

[45] Mar. 27, 1979

[54] NON-PARTITION PACKAGING DIVIDERS AND METHOD

[76] Inventor: Joe Chiba, 4577 Clearview St., Salt Lake City, Utah 84117

[21] Appl. No.: 839,019

[22] Filed: Oct. 3, 1977

[51] Int. Cl.[2] ..... B65D 71/00

[52] U.S. Cl. ..... 206/433; 206/820; 206/343

[58] Field of Search ..... 53/14; 206/433, 820, 206/343

[56] References Cited

U.S. PATENT DOCUMENTS

| | | | |
|---|---|---|---|
| 239,111 | 3/1881 | O'Meara | 206/820 |
| 265,735 | 10/1882 | Baxter | 206/820 |
| 1,352,851 | 9/1920 | Trumbull | 85/18 |
| 2,078,488 | 4/1937 | Farnham | 206/820 |
| 2,247,499 | 7/1941 | Hutchison | 206/343 |
| 2,366,510 | 1/1945 | Frank | 206/820 |
| 2,860,769 | 11/1958 | Waller | 206/820 |
| 2,928,100 | 3/1960 | Gagnon | 206/820 |
| 2,989,175 | 6/1961 | Jekel | 206/433 |
| 3,124,248 | 3/1964 | Geoffrion | 206/820 |

*Primary Examiner*—Ro E. Hart
*Attorney, Agent, or Firm*—Trask & Britt

[57] ABSTRACT

Packaging dividers are comprised of a plurality of axially linked-together separator sections. Each separator section is formed to have a preselected height and cross-sectional configuration which may be circular or cross-shaped. Each separator section is formed in axial attachment to its adjacent separator section with a reduced cross-section portion therebetween to constitute severing means. One or more separator sections may be separated from an adjacent separator section and positioned within a carton containing objects to separate said objects.

13 Claims, 10 Drawing Figures

NON-PARTITION PACKAGING DIVIDERS AND METHOD

BACKGROUND OF THE INVENTION

1. Field

This invention relates to packaging materials and specifically to non-partition dividers positionable within a carton containing objects.

2. State of the Art

In shipping breakable items such as glass bottles, containers or the like, it is typically desirable to position the objects within a carton and separate the objects from each other with partitions or separators. The separators typically in use today are fabricated from corrugated cardboard or the equivalent and are die cut to be interlocking. For example, a carton that contains four bottles, two pieces of corrugated cardboard are cut to the inside dimensions of the carton and are die cut to be interlocking at their point of intersection. The same principle applies when the carton contains six, eight, ten or whatever number of objects.

The breakable objects to be positioned within cartons vary widely in dimension. In turn, the size of cartons and partitions must each be tailored to the particular size of the object to be placed therein. Although standardization has occurred with respect to some objects, some users of cartons and partitions require specifically tailored cartons and partitions. Some of these users have a small volume or quantity of product to be placed in the specially sized containers and specially sized partitions. The cost of the carton, and in particular the partitions or separators is therefore particularly high if not excessive with respect to the volume or quantity of the product or objects involved. That is, the cost of cutting the corrugated cardboard separators or partitions and the special cost to die cut the interlocking slits in the partition is particularly excessive for a small volume or quantity of objects.

It may further be noted that assembling partitions that are die cut to interlock may require some notable amount of manual labor. That is, they are typically assembled and positioned within the carton by hand. Thereafter, objects must be loaded into the particular compartment or sections formed by the partitions or separators.

In some cases, specifically tailored cartons or carriers have been provided for particular size containers or objects. For example, U.S. Pat. No. 3,863,759 (Prodel) discloses a plastic crate or carton for transporting bottles in what may be regarded as a "six-pack". U.S. Pat. No. 3,802,592 (Wheaton) shows a tray with having compartments for storing glasses or the like. U.S. Pat. No. 1,511,606 (Hamann) shows a soft drink shipping container fabricated of wood. It has permanent installed separators made of wood which are regarded as undesirable because of the cost of manufacturing containers and separators out of wood and because they are inflexible and not resilient. U.S. Pat. No. 1,139,582 (Roberts) also shows a wooden shipping crate tailored specifically for a particular kind of object with separators permanently mounted and with receptacles sized to the object formed in the bottom of the shipping crate or case. U.S. Pat. No. 854,244 (Smith) also shows a shipping crate specifically sized and shaped for a particular type of object.

Partitions disclosed in the above-cited patents, as well as the partitions typically in use today, are not adaptable for use with a wide variety of differently sized objects. Further, the cost of the partitions disclosed in the above-cited patents and of the partitions typically in use today is excessive. That is, the cost in and of itself is excessive with respect to the wooden or solidly fabricated devices. With respect to the devices fabricated from cheaper materials known today, it may be stated that the cost is still excessive in view of the fact that the separators or partitions must be separately or individually manufactured to a specified size to accommodate the specific object to be packaged or cartonized and must thereafter be hand assembled and positioned within the carton before the objects can be placed therein. The cost associated therewith is extensive and particularly excessive for low quantities or small quantities of objects.

SUMMARY OF THE INVENTION

Packaging dividers for separating objects within a carton are comprised of a plurality of axially linked-together separator sections. Each separator section is formed to have a preselected height and a preselected cross-sectional configuration. The separator section is formed in axial attachment with its adjacent separator section and to have severing means to facilitate severing one separator section from its adjacent section proximate said attachment. The separator sections are selectively severed from each other and manually positioned in the carton to separate objects therewithin.

The separator sections are preferably made of a lightweight, slightly compressable and resilient material. In one embodiment, they may be formed to be substantially circular in cross-section and to have a base in the top wherein the adjacent separator sections are actually linked to each other base to top. Most preferably, adjacent separator sections are unitarily formed with a section of reduced cross-sectional area as compared to the cross-sectional area of the separator section between the base and the top constituting said severing means. The base may be concave and the top may be convex. The reduced cross-sectional area is preferably less than one-half the cross-sectional area of the separator section and proximate the axis of the separator section.

In a highly preferred embodiment, the separator sections are made of an expanded polystyrene. Also, the cross-sectional diameter of the separator section is selected to be from about 45% to about 52% of the diameter of the objects to be stored therein which are preferably circular objects. The separator sections are manually severable from each other.

The separator sections may also be formed to be cross-shaped in cross-section with first and second members intersecting at substantially right angles.

A method of separating objects positioned within a carton containing at least four objects positioned in two adjacent horizontal rows is also disclosed. The method comprises the positioning of separator sections between adjacent rows at a center point among each group of four objects, two objects adjacent in a first row and two objects adjacent in an adjoining second row next to said two in said first row. When said rows contain at least four objects, a packaging pad sized in width to substantially extend across said adjacent rows may be positioned between adjacent objects at least two objects inward in each row and substantially normal to said row.

BRIEF DESCRIPTION OF THE DRAWINGS

In the drawings, which illustrate the best mode presently contemplated for carrying out the invention.

DESCRIPTION OF THE ILLUSTRATED EMBODIMENT

Figure 1:
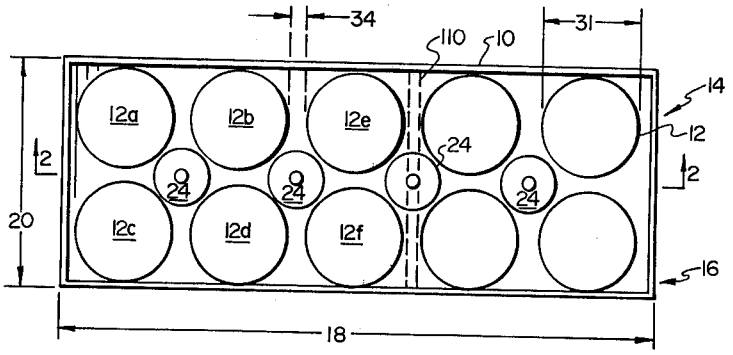
FIG. 1 is a top view of a carton containing objects with packaging dividers of the instant invention.
Figure 2:
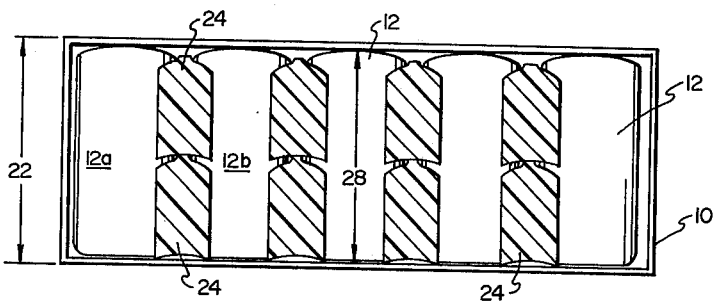
FIG. 2 is a side sectional view along the line 2—2 of the carton of FIG. 1.

FIG. 1 is a carton 10 which may be a corrugated cardboard carton or any carton typically used for carrying or shipping objects 12. As can be seen, the objects are positioned within the carton in two adjacent horizontal rows 14, 16. The carton is sized to have a length 18, a width 20 and a height 22 (FIG. 2). The carton 10, as here illustrated, is sized to accommodate the objects 12 for positioning therewithin. However, as hereinafter discussed, the carton 10 may be sized differently. Separator sections 24 are also positioned within the carton 10. As here shown, the separators 24 are positioned at an approximate center point between four adjacent objects 12i a, 12*b*, 12*c* and 12*d*, two of which, 12*a* and 12*b*, are in a first row 14 and are adjacent and next to the other two objects 12*c* and 12*d* in the adjacent row 16.

Figure 3:
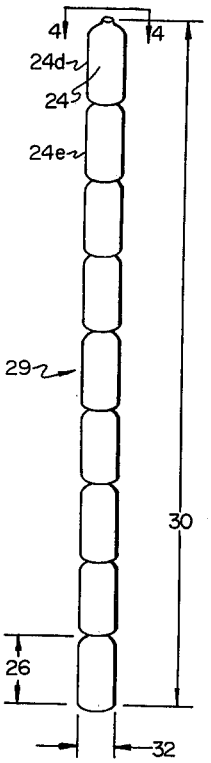
FIG. 3 is a front view perspective of packaging dividers of the instant invention.
Figure 4:
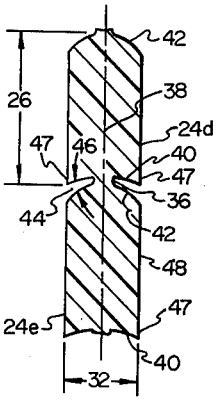
FIG. 4 is a partial cross-sectional view along section line 4—4 of the partition dividers of FIG. 3.

Referring to FIGS. 3 and 4, it can be seen that the separators 24 are substantially circular in cross-section. The separator sections 24 are sized in height 26 as selected by the user. Preferably, the height 26 is a unit height which is selected to be the height 28 (FIG. 2) of the object 12 within the carton or a height in which a whole number (e.g., 1, 2, 3 . . .) of separator sections 24 may approach, but not exceed, the height 28 of the objects 12 positioned within the carton 10. The separator sections 24 are joined to each other to form partition dividers 29. The separator sections 24 are formed together with severing means to facilitate severing one separator section 24*c* from its adjacent separator section 24*d*. Preferably, the dividers 29 are formed as a modular unit 30 to accommodate the separator requirements for an entire carton 10. For example, the partition dividers 29 of FIG. 3 are comprised of eight (8) separator sections 24 which are used in separate the objects 12 within the carton 10 of FIGS. 1 and 2. The separator sections 24 are sized with a diameter 32 which is selected to provide the objects 12, which are circular in cross-section, with a separation of approximately 3/16 of an inch. The diameter 32 is selected to be from about 45% to about 52% of the diameter of the objects 12 and preferably from about 47% to about 50% of the diameter 31 of the objects 12 to maintain the desired 3/16 of an inch clearance 34. It may be noted that the diameter 32 may be varied by the user to vary the dimensional clearance 34 between adjoining objects 12. In particular, larger diameter 32 separator units 24 may be positioned between adjoining objects 12*a*, 12*b*, 12*c* and 12*d* to permit the use of a larger size carton 10 which may be more readily available as a standard or semi-standard carton 10.

As best shown in FIG. 4, adjoining separator units 24 are physically and unitarily formed together with severing means which as here illustrated, is a breakable or severable reduced cross-sectional area 36 therebetween. The reduced cross-sectional area 36 is preferably less than one-half the cross-sectional area of the separator section 24 and is proximate the axis 38 of the separator section 24. The separator section 24 is preferably formed with a concave bottom 40 and a convex top 42. A slit 44 is thereby formed between adjacent sections 24 to permit one adjacent section to be bent with respect to its adjacent section 24. At the same time, the slit 44 is sized to limit the movement or bending of a separator 24 away from the axis 38. The bending limitation may be desirable to avoid inadvertent breaking of separator sections 24 from each other when handling the sections 24. The bending limitation is established by the shape and thickness or width 46 of the slit 44. The slit 44 permits free rotational movement about the axis 38 so that a section 24 may be severed from its adjacent section 24 by simply grasping a section 24*d* and rotating and twisting it about its axis 38. The twisting force will in turn cause the reduced cross-sectional area 36 to break or tear apart, thus severing the two adjacent sections 24*d* and 24*e*. In view of the concave bottom 40 and convex top 42, the slit 44 is shaped to be somewhat recessed. That is, the concave bottom 40 in effect forms a skirt 47 which provides as much exterior surface 48 as reasonably possible for contact with the objects 12 and which also contacts the top 42 when the section 24*d* is bent to limit the bending movement.

The sections 24 are preferably made of a lightweight and compressible material and preferably of an expanded polystyrene material. Such materials provide sufficient rigidity along with compressibility and resilience at a reasonable price.

Figure 5:
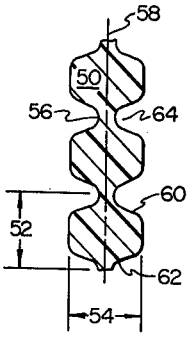
FIG. 5 is a partial cross-sectional view of separator sections of packaging dividers of the instant invention.

FIG. 5 illustrates an alternate embodiment wherein the separator sections 50 are sized in height 52 and in diameter 54 in accordance with the same principles as the separating sections 24 of FIGS. 3 and 4. The separator sections 50 are also joined together by a reduced cross-sectional area 56 centrally positioned with respect to their axis 58. However, as shown, the top 60 and bottom 62 are both convex in shape so that the slit 64 is a substantial indentation. Such a slit 64 permits the individual separator sections 50 to be bent along their axis 58 to break them apart. Also, use of separators 50, as illustrated in FIG. 5, results in the use of less material in formation or manufacture making the separators cheaper to manufacture.

Figure 6:
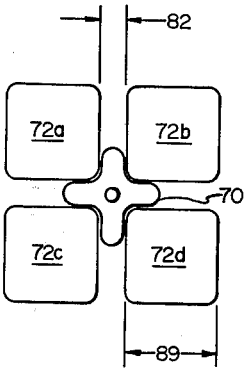
FIG. 6 is a top view of a separator section of packaging dividers with objects thereabout.
Figure 8:
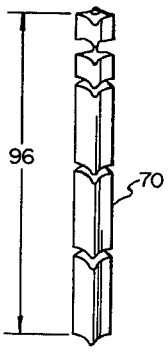
FIG. 8 is a segmented perspective view of packaging dividers of the instant invention.
Figure 7:
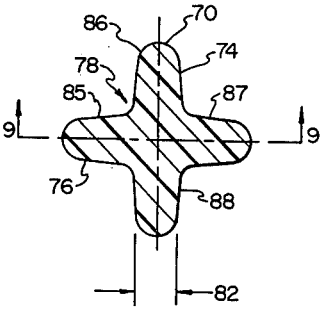
FIG. 7 is a top view of a separator section of packaging dividers of the instant invention.
Figure 9:
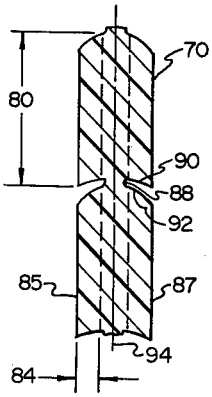
FIG. 9 is a partial cross-sectional view along section lines 9—9 of the separator section of FIG. 7.

FIG. 6 shows another alternate embodiment of the instant invention. A separator section 70 is positioned between four adjacent rectalinear shaped objects 72*a*, 72*b*, 72*c* and 72*d*. The objects are positioned within a carton comparable to the carton 10, which is not here shown. The separator 70 is cross-shaped in cross-section as best shown in FIGS. 7 and 8. It may be regarded as having first 74 and a second 76 members which intersect at substantially right angles. However, as best shown in FIG. 7, exterior surfaces 78 of the separator section 70 may be smooth or rounded in shape to facilitate useage. As shown in FIGS. 8 and 9, the separators 70 are formed with a height 80 selected on similar principals as the height 26 for the separator sections 24 of FIGS. 3 and 4. The separator members 74 and 76 may have a thickness 82 selected to be the thickness or width between objects 72*a* and 72*b* to be stored within a carton. The extended length 84 of the legs 85, 86, 87 and 88 of separator members 74 and 76 may vary as desired by the user and is preferably selected to be about one inch or about $\frac{1}{8}$ to about to $\frac{1}{4}$ the width 89 of the rectalinear objects 72.

The separator sections 70 are formed together as the separator sections 24 of the packaging dividers 29 of FIGS. 3 and 4. In particular, the separators 70 are secured to each other with severing means which is here illustrated as a reduced cross-sectional area 88, which is preferably less than $\frac{1}{2}$ of the cross-sectional area of the cross-shaped separator section 70. The bottom of separator section 90 may be shaped to be generally concave and the top 92 may be shaped to be generally convex. Such shaping, as hereinbefore discussed, provides for some additional vertical ability while permitting severing of one separator section 70 from its adjacent separator section by a twisting or rotating force about the axis 94 of the separator section 70. The separators 70, as well as the separators 50 and 24, are assembled to have a modular length 96 for similar reasons as set forth with respect to the separators 24 shown in FIG. 3. That is, the number of individual separators 70 assembled or formed is selected for a particular package or packaging purpose to provide a readily useable quantity of separators for use.

It may be noted that the separators of the instant invention do not require specific dies or die cutting. Further, no assembly is required in the process of positioning objects 12 and 72 within a carton 10. The objects 12 and 72 may be simply positioned within the carton 10. Thereafter, the separators 24, 50 or 70 are forced inbetween the objects 12 and 72 to act as separators. In turn, the filling of cartons is substantially facilitated.

Figure 10:
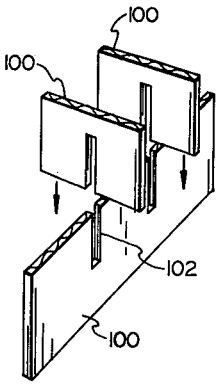
FIG. 10 is a perspective view of die cut packaging dividers.

It may be noted that cartons somewhat larger than a carton specifically tailored for objects 12 and 72 may be used by simply selecting a packaging divider having an appropriate or desired diameter 32 or equivalent dimensions 82 and 84 to fill up the carton while holding the objects 12 and 72 apart with greater separation 34 and 82. The low cost of the separators 24, 50 and 70 permits users to stockpile a quantity thereof without substantial investment and to package or carton objects 10 and 72 for shipping without the necessity of expensive or costly investment in tailored cartons 10 and specially die cut partitions 100 which are illustrated in FIG. 10 for purposes of clarification only. Partitions 100 are typically cut specifically to fit precisely and tightly within a carton 10 and to have slots 102 formed therein. The slots 102 are typically cut into the corrugated cardboard partitions 100 by using special dies so that the slots 102 are positioned and sized precisely for the dimensions of the objects 12 and 72 to be positioned within carton 10. The assembly of the specifially cut sections 100 is a time consuming and in turn expensive process. In the instant invention, the separators 24, 50 and 70 need not be specially cut for every carton 10. That is, the separators 24, 50 and 70 may be preformed and stockpiled for use to effect separation for a variety of different objects in a variety of different cartons 10.

Referring again to FIG. 1, it may be noted that the separators 24, 50 and 70 of the instant invention may also be used in combination with a partition pad 110. The pad 110 may be a sheet of styrofoam, expanded polystyrene, corrugated cardboard or any other suitable material. The pad need not be sized to the precise width 20 of the carton 10, but must be sized sufficiently to provide separation as desired between adjacent objects in adjoining rows 14, 16 of objects 12 positioned within the carton 10. To be used with the separators 24, 50 and 70 of the instant invention, the pad 110 must be positioned inwardly in a row 14 or 16 at least two objects 12. In this way, separators 24, 50 or 70 can be used to provide the needed separation between four adjoining objects 12*a*, 12*b*, 12*c* and 12*d*. Further, a pad 110 can separate only groups of four. They cannot be placed on either side of a pair of objects 12*e* and 12*f* because the necessary separation of objects in adjoining rows would not be effected. Cost considerations, as well as the dimensions of a particular carton 10, may dictate the need to use one or more pads 110 in combination with separator sections 24, 50 or 70.

It is to be understood that the embodiments of the invention above-described are merely illustrative of the application of the principals of the invention. Reference herein to details of the illustrated embodiment is not intended to limit the scope of the claims which themselves recite those features regarded as essential to the invention.

I claim:

1. A packaging divider for separating objects positioned within a carton, said divider being comprised of a plurality of axially linked-together separator sections wherein:

each separator section is formed to have a preselected height and a preselected cross-sectional configuration;

each separator section is formed in axial attachment with its adjacent separator section and to have severing means to facilitate severing one separator section from its adjacent section proximate said attachment, and wherein said separator sections are selectively severed from each other for positioning in said carton to separate objects therewithin.

2. The packaging divider of claim 1 wherein the height of said separators is selected to be a unit height and wherein said plurality of separator sections are attached to form said partition divider having a modular length.

3. The packaging divider of claim 2 wherein said separator sections are made of a lightweight, slightly compressible and resilent material.

4. The packaging divider of claim 3 wherein said separator sections are formed to be substantially circular in cross-section, to have a base and to have a top, and wherein adjacent separator sections are axially linked to each other base to top.

5. The packaging divider of claim 4 wherein adjacent separator sections are unitarily formed with a section of reduced cross-section area as compared to the cross-sectional area of said section therebetween constituting said severing 6. The packaging divider of claim 5 wherein said base is concave and said top is convex and wherein said section of reduced cross-section is less than one-half the cross-section of said separator section and proximate the axis of said separator section.

7. The packaging divider of claim 6 wherein the objects are circular in cross-section and wherein the cross-sectional diameter of said separator sections is from about forty-five percent (45%) to about fifty-two percent (52%) of the diameter of the said objects.

8. The packaging divider of claim 7 wherein the separator sections are made of gas expanded polystyrene and wherein said separator sections are manually severable.

9. The packaging divider of claim 3 wherein said separator sections are formed to be cross-shaped in cross-section with first and second members intersecting at substantially right angles, wherein said separator sections have a base and a top, and wherein adjacent separator sections are linked to each other base to top.

10. The packaging divider of claim 9 wherein adjacent separator sections are unitarily formed together with a section of reduced cross-sectional area therebetween as compared to the cross-sectional area of said separator section to constitute said severing means.

11. The packaging separator of claim 10 wherein said section of reduced cross-sectional area is less than one-half the cross-sectional area of said separator section and proximate the axis of said separator sections.

12. The packaging separators of claim 11 wherein the objects are substantially rectalinear in cross-section and wherein said first and second members have a thickness sufficient to separate said objects from each other.

13. The packaging dividers of claim 12 wherein said separator sections are made of gas expanded polystyrene and wherein said separator sections are manually severable.

* * * * *